US005740626A

United States Patent [19]

Schuetz et al.

[11] Patent Number: 5,740,626

[45] Date of Patent: Apr. 21, 1998

[54] MODIFIED FIREARMS FOR FIRING SIMULATED AMMUNITION

[75] Inventors: Robert C.E. Schuetz; Brian D. Schuetz, both of Olympia, Wash.

[73] Assignee: Olympic Arms, Inc., Olympia, Wash.

[21] Appl. No.: 832,497

[22] Filed: Apr. 3, 1997

[51] Int. Cl.[6] ..... F41C 27/00

[52] U.S. Cl. ..... 42/106; 42/76

[58] Field of Search ..... 42/106, 76.01; 89/193, 145; 434/16, 18, 11, 15, 17, 19, 21, 24

[56] References Cited

U.S. PATENT DOCUMENTS

| | | | |
|---|---|---|---|
| 2,541,025 | 2/1951 | Bluford et al. | 89/29 |
| 2,857,812 | 10/1958 | Nichols | 89/29 |
| 3,793,922 | 2/1974 | Angell et al. | 89/180 |
| 4,088,056 | 5/1978 | Dallaire | 89/1.7 |
| 4,590,698 | 5/1986 | Finn | 42/78 |
| 5,218,163 | 6/1993 | Dabrowski | 89/193 |
| 5,351,598 | 10/1994 | Schuetz | 89/185 |
| 5,359,937 | 11/1994 | Dittrich | 102/430 |
| 5,388,500 | 2/1995 | Petrovich | 89/194 |
| 5,448,940 | 9/1995 | Schuetz et al. | 89/185 |
| 5,492,063 | 2/1996 | Dittrich | 102/430 |
| 5,499,569 | 3/1996 | Schuetz | 89/197 |
| 5,520,019 | 5/1996 | Schuetz | 42/49.02 |

*Primary Examiner*—Charles T. Jordan
*Assistant Examiner*—Meena Chelliah
*Attorney, Agent, or Firm*—Michael J. Caddell

[57] ABSTRACT

The present invention discloses a firearms safety system for adapting conventional handheld firearms to fire non-deadly simulated training ammunition, which system provides a series of gas relief ports and passages to prevent the successful firing of live ammunition in the firearm. The system can be advantageously utilized in modified M16 type military type rifles which have been previously adapted to fire pistol cartridges such as the 9 mm and .40 S&W calibers.

6 Claims, 1 Drawing Sheet

MODIFIED FIREARMS FOR FIRING SIMULATED AMMUNITION

BACKGROUND OF THE INVENTION

The present invention is directed to firearms which can be converted to fire simulated ammunition for training purposes, for example in military weapons like the M16 shoulder-mounted rifle, and the 9 mm semiautomatic Beretta handgun. The M16 automatic, or select-fire, rifle and the AR15 semiautomatic rifle have been the standard issue weapons of the U.S. military and civilian police departments for decades. The rifle design was originally created by Eugene Stoner and developed by Fairchild Engine and Airplane Company in the 1950's. Modified versions of the M16 designated as the M16A1 and the M16A2 are currently in use by armed forces in the U.S. and throughout the world. A civilian semiautomatic version of the M16, designated as the AR15 is sold to civilians by Olympic Arms, Inc. of Olympia, Wash. When used herein, the phrase "M16" is intended to include all versions of the M16 and AR15 previously and currently being produced.

One of the original patents issued on the M16 rifle was issued to Eugene Stoner on Sep. 6, 1960, as U.S. Pat. No. 2,951,424, and disclosed the M16 bolt and bolt carrier system as well as the gas system used therewith. The patent discloses a rifle utilizing a gas tube that extends from a gas port in the barrel, through the front sight base, back into the receiver, and into a gas tube pocket or "gas key" attached to the bolt carrier. Stoner also received U.S. Pat. No. 3,198,076 on Aug. 3, 1965 which discloses a gas operated, magazine-fed rifle that can be readily converted to a belt-fed machine gun by inverting the barrel assembly.

More recently, patents have been issued on modified M16 rifles that are chambered for the relatively low-pressure, short wide pistol cartridges such as the 9 mm, the 10 mm, and the .40 S&W calibers. These cartridges generate approximately half the internal gas pressures that normal fire cartridges such as the 5.56 mm Nato cartridge do. For example, the 9 mm generates pressures in the range of 20,000 to 30,000 CUP whereas modern military rifle cartridges generate pressures in the range of 45,000 to 55,000 CUP (copper units of pressure). Two such patents disclosing modified M16 rifles for firing pistol cartridges are U.S. Pat. No. 5,499,569 and U.S. Pat. No. 5,520,019, dated Mar. 19, 1996, and May 28, 1996, respectively, both issued to Brian D. Schuetz and assigned to the assignee of the present invention. Two other patents disclosing modified M16 rifles are U.S. Pat. No. 5,448,940 and U.S. Pat. No. 5,351,598, issued on Sep. 12, 1995, and Oct. 4, 1994, respectively, to Robert C. E. Schuetz et al. The aforementioned six patents issued to Stoner and Schuetz, et al, are all incorporated herein by reference in their entirety.

In the training of military troops and civilian police forces, the trainers are limited to the types of firearms that can be used in such training because of the inherent dangers in using live ammunition during training exercises. The alternatives to using live ammunition include using blanks in standard military weapons such as the M16 or using non-military pseudo-weapons such as CO2 operated rifles that shoot frangible projectiles made up of plastic capsules filled with a colored marking fluid such as watercolor paint (often referred to as "paintball guns"). The advantages of shooting blanks in actual military rifles is that the trainees actually get the feel of the weapon they will be carrying; however the disadvantage is that no one can tell how accurate the trainee is under training conditions because of the lack of projectiles with the blank cartridges. The alternative offers the opposite advantages and disadvantages, i.e. the CO2 guns do not resemble the military type of weapons in design, weight, handling and all other aspects, even though they do provide a projectile that allows some tracking of accuracy; although only at very limited distances because of the lack of velocity and distance with the CO2-driven frangible projectiles.

What has long been needed has been a system of firing simulated ammunition from weapons such as the M16 rifle and the 9 mm Beretta handgun which are standard-issue weapons in the U.S. military.

SUMMARY OF THE INVENTION

The present invention overcomes the deficiencies of the conventional weapons systems by providing a system and method of use wherein simulated ammunition can be fired in M16 types of rifles and 9 mm handguns and still maintain the appearance and effectiveness of these types of guns. The modified M16 rifle of the invention is adapted for use with simulated ammunition which is currently available commercially, while also having a safety system to prevent the effective firing of live ammunition in the modified gun. The safety system comprises a blowout passage in the gun's chamber which would allow the sidewall of a standard, live-ammo cartridge, which is inadvertently loaded in the gun and fired, to blow out and bleed off the pressure, thereby preventing the normal lead bullet from traveling down the bore of the rifle and presenting a danger during any training exercise.

DESCRIPTION OF THE PREFERRED EMBODIMENTS

Figure 1:
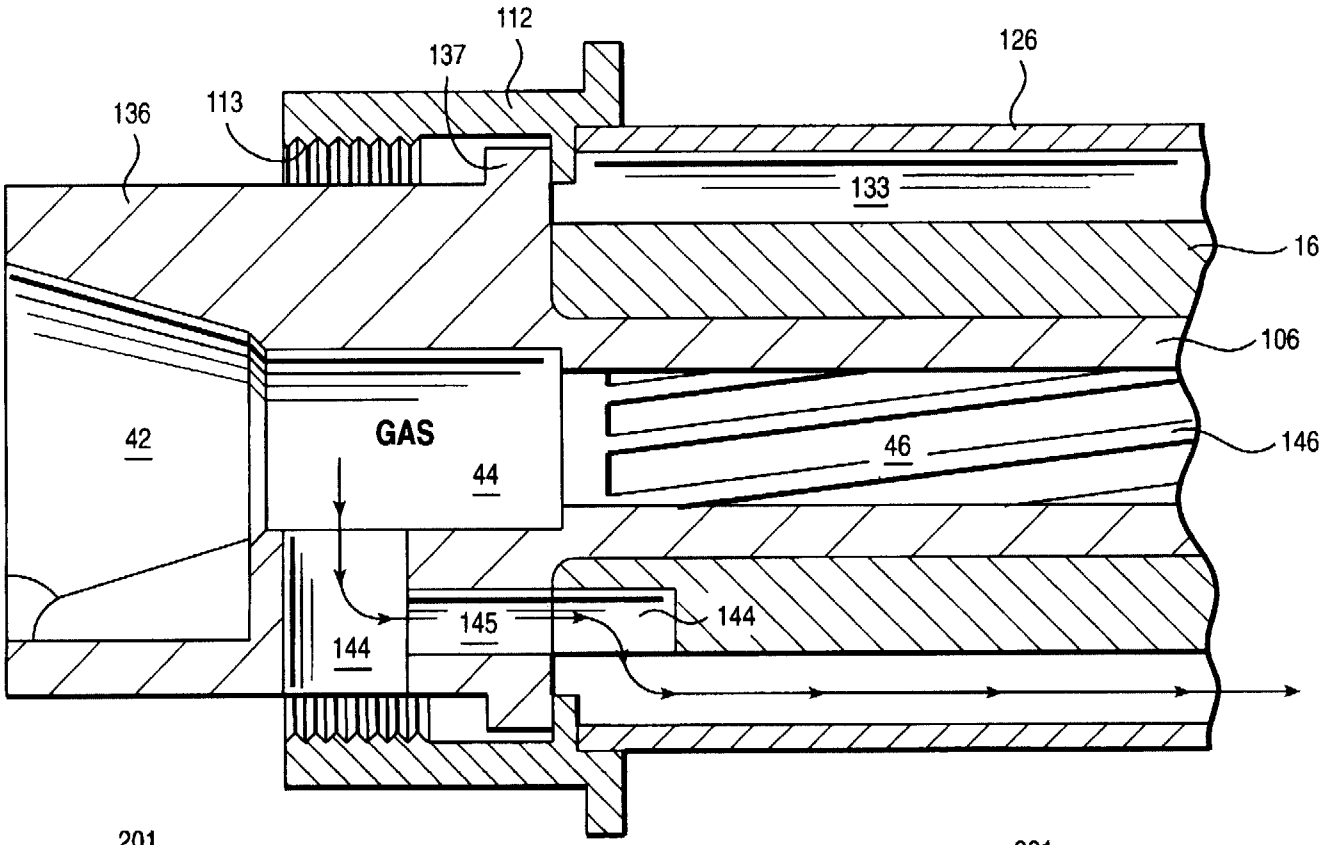
FIG. 1 is a partial cross-sectional drawing of the chamber area of the modified M16 rifle of the present invention illustrating the pressure relief system of the invention.

The present invention will be described in reference to the modified M16 as disclosed in the aforementioned incorporated Schuetz patents, U.S. Pat. Nos. 5,499,569 and 5,520,019. It will also be described in reference to commercially available simulated ammunition such as that manufactured according to U.S. Pat. Nos. 5,492,063; 5,359,937; and 5,375,529; the specifications of which are hereby incorporated by reference. Reference numbers in this application refer to similar or identical features of the same-numbered features in the incorporated Schuetz patents. The aforementioned modified M16 rifle has been further modified in this invention by replacing the barrel, the chamber assembly, and the barrel nut with the modified parts illustrated in FIG. 1.

In the figure, a cartridge chamber 44 is machined or cast into a steel barrel extension 136 which is a generally cylindrical collar having the chamber substantially centrally located therein and a cylindrical rifled bore 46 extending forward therefrom. Rifled bore 46 is defined by cylindrical extension tube 106 formed on the forward end of barrel extension 136. A generally conical-shaped breech 42 is formed in the rearward end of extension 136 and feeds into chamber 44. Chamber 44 is of the same size and shape as a standard pistol cartridge such as the 9 mm Parabellum (9×19 mm) cartridge. Tube 106 is formed with a plurality of internal helical rifling grooves formed therein. The bore diameter of bore 46 is substantially less than the bore of a conventional weapon that would be chambered for the same cartridge as the chamber 44. For example, in one embodiment of the invention chamber 44 was machined to fit the 9 mm Parabellum cartridge which has a nominal diameter of 9 mm or about 0.360 inches. The bore diameter for a conventional 9 mm weapon is in the range of about 0.355 to about 0.360 inches. The bore diameter however for the present invention where the chamber is set for 9 mm is only about 0.300 inches to 0.310 inches, a reduction of almost 0.060 inches from the conventional bore size. Therefore it is obvious that a conventional projectile from a 9 mm live cartridge would not be able to pass down bore 46 due to the huge interference caused by the 0.060 inch bore difference. This is a safety factor arranged to prevent an accidental firing of a live round during a training exercise, and is more fully described hereinbelow with respect to the mode of operation of the invention.

A tightly-fitted barrel 16 slides over tube 106 and provides barrel structure and weight similar to a standard 9 mm M16 barrel. A conventional M16 barrel nut 112 slides over a radially extended shoulder 137 and attaches to the M16 receiver (not shown) via internal threaded section 113, thereby securing the barrel/chamber assembly to the M16 receiver. Barrel 16 may be attached to internal barrel tube 106 by conventional means such as screws, pins, welding, etc.

Breech 42 is shaped and sized to receive the conical bolt face of the modified M16 rifle of the aforementioned incorporated Schuetz patents as described therein. The difference between the present chamber structure and the aforementioned M16 chamber structure is the presence of the gas relief port 144 passing through the wall of barrel extension 136. Port 144 may be a cylindrical hole bored completely through the wall of the barrel extension. It also communicates with a forward extending gas exhaust channel 145 that goes from port 144 and exits out the forward face of the barrel extension. Barrel 16 has a similar gas channel 141 formed in the outward edge of the rearward end of the barrel and adapted to align with channel 145. Although gas port 144 is shown extending all the way through the wall of barrel extension 136, this is done only for ease of forming the port, and in fact the port only needs to extend radially outward far enough to communicate fully with channels 145 and 141. Channel 141 extends forward sufficiently to clear the end of sleeve 126 and to communicate effectively with the annular space 133 formed by the concentric arrangement of blast sleeve 126 around barrel 16. Relief port 144 is arranged to intersect the chamber wall so that it will also intersect the wall of any conventional brass ammunition cartridge which is inadvertently inserted into the weapon's chamber.

Figure 2:
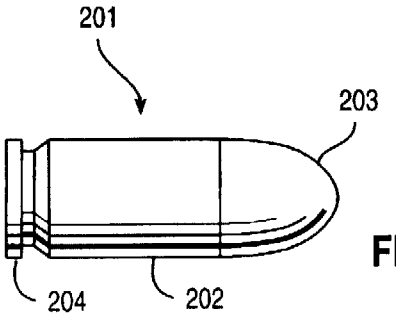
FIG. 2 is a drawing of a live-ammunition round typical of the commercially available handgun cartridge such as the 9 mm Parabellum; and, FIG. 3 is a drawing of a typical simulated training round in 9 mm for use in the present invention.

FIG. 2 is a side view of a conventional pistol cartridge live round 201 having a brass or other type of metal case 202, and a projectile 203 consisting of a metal-jacketed lead bullet. An extractor rim 204 is formed on the rear face of the case 202. Cartridges 201 are commercially available all over the world in calibers such as 9 mm, 10 mm, 380 acp, and .40 S&W. The case 202 holds a primer system in the base and gunpowder inside the case below the bullet. Internal pressures generated during ignition of such cartridges are in the range of 20,000 to about 35,000 CUP (copper units of pressure).

Figure 3:
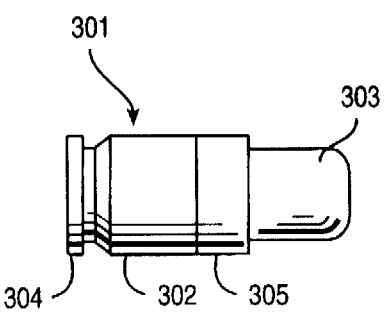

FIG. 3 is a side view of a simulated cartridge 301 used in training weapons for simulating the action of a conventional live round. They are commercially available in 9 mm caliber and are made according to the aforementioned incorporated patents. Primarily they consist of a metallic case 302, a rimmed base 304, a plastic or otherwise frangible projectile 303, and a plastic bushing or piston 305. The simulated cartridge is designed to fire a light frangible projectile at lower than conventional velocities while still providing sufficient force to operate the bolt system of the blowback M16 of the aforementioned Schuetz patents. The plastic piston 305 serves to provide a rearward directed force to case 302 to cycle the blowback bolt system of the modified M16 rifle. Projectiles 303 are light enough and frangible enough to prevent injury to any person struck by one during training exercises. If desired, the projectiles may be filled with a brightly-colored marking liquid such as watercolor paint or other type of non-permanent paint or dye. It should be noted that the diameter of the projectile in the simulated cartridge is substantially smaller than a like cartridge in a live round. For example in the 9 mm cartridge mentioned previously, the nominal diameter of a 9 mm lead projectile is in the range of 0.350 to 0.360 inches, whereas the nominal diameter of a 9 mm simulated round projectile is only about 0.300 to 0.310 inches. This is true even though the case diameter of the simulated round is approximately the same as the case diameter of a standard 9 mm cartridge so that conventional magazines can be used with the simulated rounds.

In typical operation, the simulated cartridge 301 is moved into chamber 44 by the action of the bolt assembly of the modified M16 just as though it were a conventional cartridge and as further described in the aforementioned Schuetz patents. Then the activation of the firing pin by movement of the trigger fires the simulated cartridge and drives the light frangible bullet down the grooved internal barrel 106. The rearward push of the case 302 against the bolt face cycles the gun and allows the fired case to be ejected and a fresh round to be inserted into the chamber. This process continues until all of the ammunition available to the firearm from the magazine is exhausted or until the operator of the weapon decides to quit firing.

The operation of the system when the operator inadvertently tries to fire a conventional high-power cartridge in the weapon serves to protect both the weapon, the operator, and anyone else in the area involved in the training exercise. When an actual live round (non-simulated) of the same caliber as the simulated cartridge, is inserted into the weapon by mistake or when an uneducated attempt is made to fire such a round in a modified M16, the rifle will allow the cartridge to be fired just as though it was also a simulated round. However, the action of the system immediately after the firing of the live round becomes very different from that of the conventional M16 rifle and of the simulated round.

With the present safety system, when the live round 201 is fired in the modified chamber 44, the pressure which builds up rapidly in the cartridge to the aforementioned CUP range, immediately begins to stress the cartridge wall at its location over port 144, stretching the metal of the case wall into the port until it ruptures and blows a hole in the case wall slightly smaller than the diameter of port 144. This allows the buildup in gas pressure inside the cartridge case 202 to entirely bleed off through the port and out channels 145 and 141, where it is dissipated by blowing forward into annular space 133. This space allows the gases to exit the rifle near the end of the handguard after it has been cooled and slowed by its great increase in volume.

By the time the gases exit annular space 133 they are no longer of any danger to the weapon operator nor to anyone in the area of the weapon. Because of the rapid blowout of the case wall, the bullet 203 never has the opportunity to exit the case 202 and is easily extracted as a single unit along with the case by the cycling of the bolt by the weapon's operator. This system will operate the same each time a live round is attempted to be fired in the weapon so that no matter how many live rounds the weapon's magazine contains, the operator will never be able to fire an actual bullet from this firearm. Also, the noise and gases exiting from the handgaurd area, and the lack of a projectile from the weapon, serve to give the operator and those around him a very clear indication that the weapon has been loaded with live ammunition instead of simulated ammunition.

In the event however, that a bullet in a live cartridge is lightly crimped in its case and the cartridge is loaded into the modified weapon of this invention and fired, and the bullet does manage to leave the case and move enough pressure behind it to move not have enough pressure behind it to move any further than the very beginning of rifled section 46 where, because of the previously described reduction in bore diameter 46, it will encounter enough resistance to prevent it from traveling out of the immediate chamber area. Then, if the rifle cycles and tries to load a new cartridge into the chamber, the cartridge will not go into the chamber because of the presence of the lead bullet in the end of chamber 44 abutting the rear end of rifled bore 46, and the operator will realize that a live round was attempted to be fired in the weapon. Thereafter it will be a simple matter of clearing the chamber of the fresh round, running a cleaning rod down the bore from the muzzle end and lightly tapping the fired bullet loose from where it is lightly lodged in the rearward end of rifled section 46.

Thus it can be seen that the present invention provides a modified M16 rifle system for firing simulated ammunition, which rifle system offers the features of having a fail-safe system for preventing the firing of live ammunition and thereby not endangering the lives of personnel involved in the training exercise.

Although the invention is described with respect to the military style of rifles, it is clear that the invention could easily be applied to semiautomatic sporting rifles and other types of rifles, such as lever and bolt action guns, as well. In addition, the invention could also be used in semiautomatic pistols such as the Beretta 9 mm pistol currently in use as a sidearm by the U.S. military and in other similar semiautomatic pistols used by various military units throughout the world. Even though a specific preferred embodiment of the present invention has been described in the detailed description above, the description is not intended to limit the invention to the particular forms or embodiments disclosed therein since they are to be recognized as illustrative rather than restrictive and it would be obvious to those skilled in the art that the invention is not so limited. Thus the invention is declared to cover all changes and modifications of the specific example of the invention herein disclosed for the purposes of illustration which do not constitute departures from the spirit and scope of the invention.

The embodiments of the invention in which an exclusive property or privilege is claimed are defined as follows:

1. A handheld firearm for firing simulated ammunition, said firearm comprising a barrel having a cartridge chamber formed at one end thereof, and a pressure safety system adapted for preventing the successful completion of a firing cycle of live ammunition, said safety system comprising a pressure relief port formed through the wall of said chamber and arranged to align with the wall of a live cartridge located in the chamber of said firearm, said port being of sufficient diameter to allow a portion of the wall of a cartridge fired in said chamber to be expelled through said port, and said port communicating with a discharge channel system arranged to divert and disperse gases from a fired cartridge therethrough.

2. The firearm of claim 1 wherein said firearm is a modified M16 adapted to fire pistol-caliber cartridges, and said port passes through the wall of said chamber and intersects a longitudinal forward directed channel system arranged to direct gases passing through said port forward of said chamber inside the handguard of said modified M16.

3. The firearm of claim 2 wherein said modified M16 further comprises a barrel extension defining a cylindrical sleeve containing said chamber and further having attached thereto and extending forward therefrom a rifled internal barrel tube, an external barrel sleeve fixedly attached to and snugly encircling said internal barrel tube, an internally threaded M16 barrel nut adapted for threaded engagement with an M16 receiver, and a blast containment sleeve fixedly attached to said barrel nut and concentrically encircling said external barrel and spaced therefrom to form an annular blast dispersion zone; said barrel nut having an engagement shoulder for engaging and securing said barrel extension to an M16 receiver.

4. The firearm of claim 3 wherein said internal barrel tube has a rifled bore of substantially reduced diameter from that of said chamber.

5. A modified M16 rifle adapted to fire pistol-caliber cartridges, the improvement in said rifle comprising a blowback bolt assembly having a conical boltface and a conical breech formed in a barrel extension, said breech communicating with a cartridge chamber formed in said extension, an internally rifled barrel tube being attached to and extending forward from said extension and a gas relief port formed through the wall of said chamber in said extension, a gas dispersion channel system communicating with said relief port and extending forward into the handguard of said M16 rifle; wherein said relief port and said channel system are adapted to relieve gas pressure when live ammunition is fired in said chamber.

6. The modified M16 rifle of claim 5 wherein said internally rifled barrel tube has a internal bore diameter substantially reduced from the diameter of said cartridge chamber.

* * * * *